US011540636B1

(12) United States Patent
Yu

(10) Patent No.: US 11,540,636 B1
(45) Date of Patent: Jan. 3, 2023

(54) FOLDABLE HANGING BASKET

(71) Applicant: LINHAI XINGHE ARTS & CRAFTS CO., LTD, Zhejiang (CN)

(72) Inventor: Fengming Yu, Zhejiang (CN)

(73) Assignee: LINHAI XINGHE ARTS & CRAFTS CO., LTD, Zhejiang (CN)

( * ) Notice: Subject to any disclaimer, the term of this patent is extended or adjusted under 35 U.S.C. 154(b) by 0 days.

(21) Appl. No.: 17/381,199

(22) Filed: Jul. 21, 2021

(51) Int. Cl.

| | |
|---|---|
| ***A47C 5/02*** | (2006.01) |
| ***A45F 3/26*** | (2006.01) |
| ***A47C 3/025*** | (2006.01) |
| ***A47C 4/28*** | (2006.01) |
| ***A47C 4/02*** | (2006.01) |

(52) U.S. Cl.
CPC ..... *A47C 5/02* (2013.01); *A45F 3/26* (2013.01); *A47C 3/0252* (2013.01); *A47C 3/0255* (2013.01); *A47C 4/02* (2013.01); *A47C 4/28* (2013.01)

(58) Field of Classification Search
CPC ..... A47C 5/02; A47C 3/0252; A45F 3/26
USPC ..... 297/16.2, 258.1, 277
See application file for complete search history.

(56) References Cited

U.S. PATENT DOCUMENTS

| | | | | |
|---|---|---|---|---|
| 10,631,647 | B1 | 4/2020 | Wu et al. | |
| D931,629 | S * | 9/2021 | Xie | D6/347 |
| D935,205 | S * | 11/2021 | Xie | D6/347 |
| 11,369,201 | B2 * | 6/2022 | Yu | A47C 3/16 |
| 2015/0335136 | A1 * | 11/2015 | Wehner | A47C 4/045 297/273 |
| 2020/0367653 | A1 * | 11/2020 | Xuemin | A47C 3/0255 |
| 2022/0183467 | A1 * | 6/2022 | Sze | A47C 4/28 |

FOREIGN PATENT DOCUMENTS

| | | | | |
|---|---|---|---|---|
| CN | 109805649 A | * | 5/2019 | A45F 3/22 |
| CN | 210696767 U | * | 6/2020 | |
| CN | 211380415 U | * | 9/2020 | |
| CN | 212698227 U | * | 3/2021 | |
| CN | 212754926 U | * | 3/2021 | |
| CN | 113116070 A | * | 7/2021 | |
| CN | 215382609 U | * | 1/2022 | |

OTHER PUBLICATIONS 13 page PDF of machine translation of CN-212698227-U. (Year: 2021).*

(Continued)

*Primary Examiner* — Robert Canfield
(74) *Attorney, Agent, or Firm* — JCIP Global Inc.

(57) ABSTRACT

A foldable hanging basket includes a hanger and a hanging basket body. The hanging basket body is suspended on the hanger by a sling chain. The hanging basket body comprises a hanging basket chair and a lifting frame assembly. The lifting frame assembly comprises a main frame and several auxiliary frames. The main frame and the several auxiliary frames are arranged in intervals, a lower border of the main frame is hinged and matched with a front border of the hanging basket chair, and two ends of each of the several auxiliary frames are successively hinged and matched with borders on both sides of the hanging basket chair. The main frame and the auxiliary frames may be rotated and folded in a plane of the hanging basket chair.

16 Claims, 8 Drawing Sheets

(56) References Cited

OTHER PUBLICATIONS 3 page PDF of machine translation of CN-209965775-U. (Year: 2020).*
3 page PDF of machine translation of CN-211380415-U. (Year: 2020).*
3 page PDF of machine translation of CN-211186496-U. (Year: 2020).*

* cited by examiner

FOLDABLE HANGING BASKET

BACKGROUND

Technical Field

The disclosure relates to the field of leisure furniture, in particular to a foldable hanging basket.

Description of Related Art

As the pressure from life and work increases, people are yearning for a leisurely and comfortable home life. After hard work outside, people are more eager to go back to their safe and comfortable nest for a rest. In recent years, fashionable leisure hanging chairs are becoming popular in modern cities.

However, the existing structure of hanging chair usually comprises a base, a vertical pole and a hanging chair. Nevertheless, the base and vertical pole are usually designed as a fixed structure, resulting in a large volume and a high storage and transportation cost.

Therefore, for example, US patent publication of U.S. Ser. No. 10/631,647B1 discloses a foldable hanging chair, which comprises a frame, a base, at least one support rod and flexible connection members. The frame is foldably installed at a bottom of the frame. The support rod is foldably installed at one side of the frame. The flexible connection members connect the frame, the base, and the support rod together. In an unfolded state, both the support rod and the base are at a certain angle to the frame, and the frame, the base, the support rod, and the flexible connection members enclose an accommodation space. In a folded state, both the support rod and the base are close to one side of the frame. Although this structure may make the hanging basket folded, in its folding process, there is obstruction between the frames, and the frames may overlap, resulting in a relative limit to the folding volume and that it cannot be folded in one plane.

SUMMARY

The objective of the present invention is to provide a foldable hanging basket to solve the above technical problems, the hanging basket has the following characteristics: a reasonable design, convenient use, foldable so as to reduce the occupying area, and it is easy for transportation.

The technical problem solved in the present invention can be solved with the following technical scheme.

A foldable hanging basket includes a hanger and a hanging basket body. The hanging basket body is suspended on the hanger by a sling chain. The hanging basket body comprises a hanging basket chair and a lifting frame assembly. The lifting frame assembly comprises a main frame and several auxiliary frames. The main frame and the several auxiliary frames are arranged in intervals, a lower border of the main frame is hinged and matched with a front border of the hanging basket chair, and two ends of each of the several auxiliary frames are successively hinged and matched with borders on both sides of the hanging basket chair. The main frame and several auxiliary frames may be rotated and folded in a plane of the hanging basket chair.

In an embodiment of the disclosure, each of the auxiliary frames is of an inversed U shape, and the several auxiliary frames are arranged backward from larger size to smaller size. When the main frame and the several auxiliary frames are rotated and folded in the same plane with the hanging basket chair, the several auxiliary frames and the hanging basket chair are in an intracavity of the main frame.

In an embodiment of the disclosure, when the main frame and the several auxiliary frames are in a state of suspension and unfolding, an included angle between the main frame and the hanging basket chair is greater than an included angle between the auxiliary frames and the hanging basket chair.

In an embodiment of the disclosure, two lifting lugs are arranged outside the front border of the hanging basket chair, and two hinge seats are arranged inside the lower border of the main frame. The lifting lugs and the hinge seats are correspondingly matched, and are hinged with hinge shafts.

In an embodiment of the disclosure, several hinge holes are arranged on the borders on the two sides of the hanging basket chair, and hinge supports are arranged on the two ends of each of the auxiliary frame. The hinge supports and the hinge holes are hinged with hinge shafts.

In an embodiment of the disclosure, the hanging basket chair comprises a hanging basket chair frame and a mesh pad located within the hanging basket chair frame, and the mesh pad is composed of several crisscrossed rods.

In an embodiment of the disclosure, an auxiliary support extending outwards is arranged in front of the borders on the both sides of the hanging basket chair, the auxiliary support is provided with a hinge hole, and the auxiliary support is used to match with the auxiliary frame closest to the main frame.

In an embodiment of the disclosure, several braided ropes are connected between the main frame, the auxiliary frames and the hanging basket chair, the braided ropes form a hanging basket net, and the braided ropes are made of flexible material.

In an embodiment of the disclosure, the main frame, the auxiliary frames and the hanging basket chair are connected via hanging basket cloth, and the hanging basket cloth is used to completely or partially cover the main frame and the auxiliary frames.

In an embodiment of the disclosure, The sling chain comprises a sling chain body and a spring hook, one end of the sling chain body is matched with one end of the spring hook, the other end of the sling chain body is matched with a hoist ring at an upper end of the main frame, and the other end of the spring hook is matched with the hanger.

In an embodiment of the disclosure, the hanger comprises suspenders and a base, and each of the suspenders is of a detachable suspender structure.

In an embodiment of the disclosure, each of the suspenders comprises an upper suspender and a lower suspender, the upper suspender comprises an upper arc-shaped rod part and an upper straight rod part disposed integrally, and the lower suspender comprises a lower straight rod part and a lower arc-shaped rod part disposed integrally.

In an embodiment of the disclosure, a lower end of the upper straight rod part is socketed with an upper end of the lower straight rod part.

In an embodiment of the disclosure, the base is a detachable base, and the base comprises a center seat and several supporting legs. The center seat comprises several central inserting bars welded on the lower arc-shaped rod part, and a single supporting leg is used to be socketed with a single center inserting bar.

In an embodiment of the disclosure, the base is a ring base, a reinforcing beam is arranged in the ring base, and the ring base is formed by socketing detachable ring pipes.

In an embodiment of the disclosure, the base comprises a C-shaped bottom frame, the C-shaped bottom frame is provided with a reinforcing beam, and the C-shaped bottom frame is formed by socketing detachable circular pipes.

Compared with the prior art, the present invention has the following distinguished advantages and effects. The present invention optimizes the structure of the lifting frame assembly, and hinges and matches it with the hanging basket chair, so that each hinge position point is in a same plane, so as to achieve a better overall folding of the lifting frame assembly in a plane, thus further reducing the package volume during transportation. The present invention also optimizes the structure of suspender and base, so as to reduce the package volume during transportation with a removable and fast-assembling structure design.

The features of the present invention can be clearly understood by referring to the schematic diagram of the present invention and the following detailed description of preferred embodiments.

To make the aforementioned more comprehensible, several embodiments accompanied with drawings are described in detail as follows.

DESCRIPTION OF THE EMBODIMENTS

To make the technical means, creative features, objective and effects achieved in the present invention easy to understand, the present invention is further elaborated hereafter in connection with the drawings.

Figure 1:
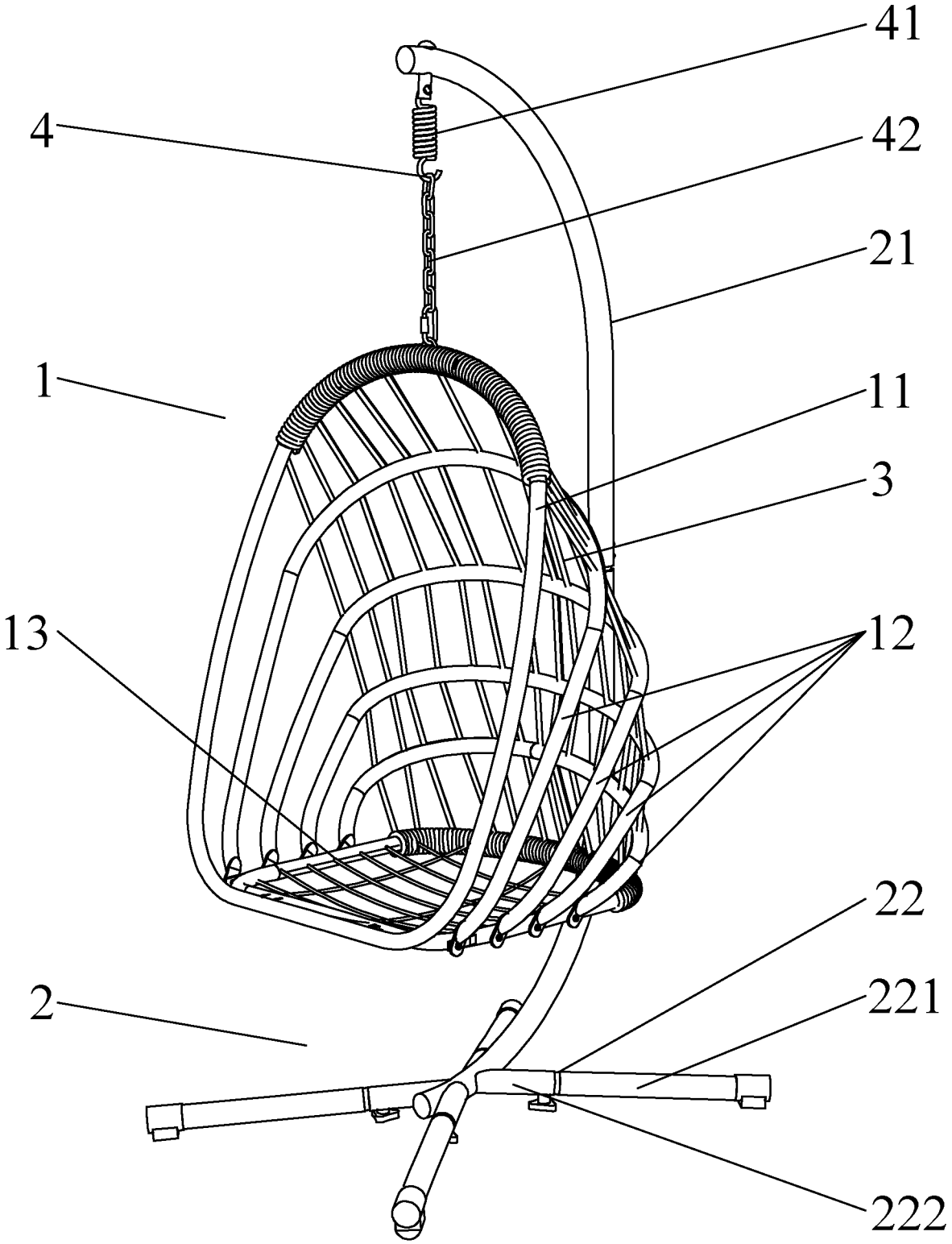
FIG. 1 is structure diagram 1 of the whole structure of the present invention.
Figure 2:
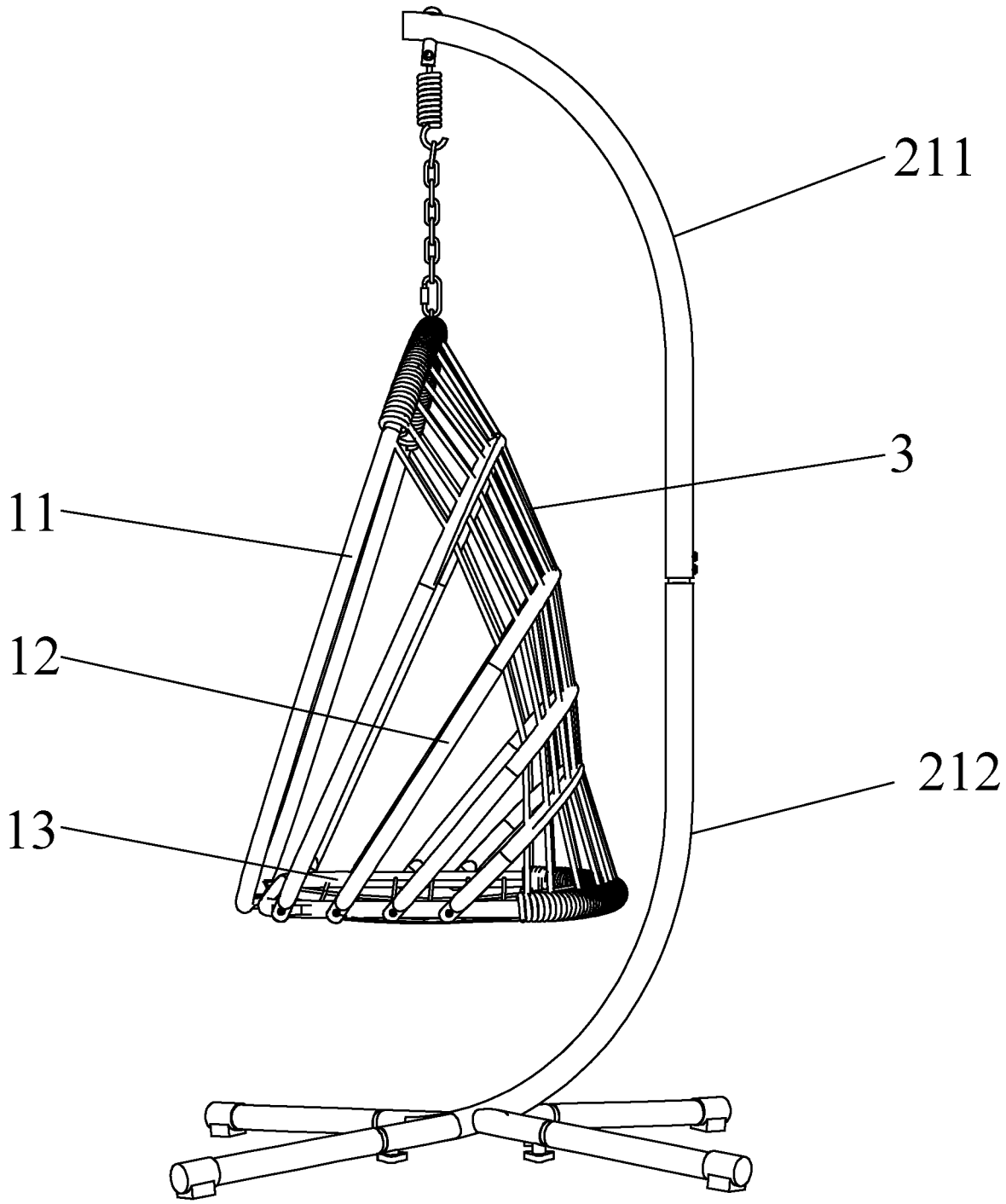
FIG. 2 is structure diagram 2 of the whole structure of the present invention.
Figure 3:
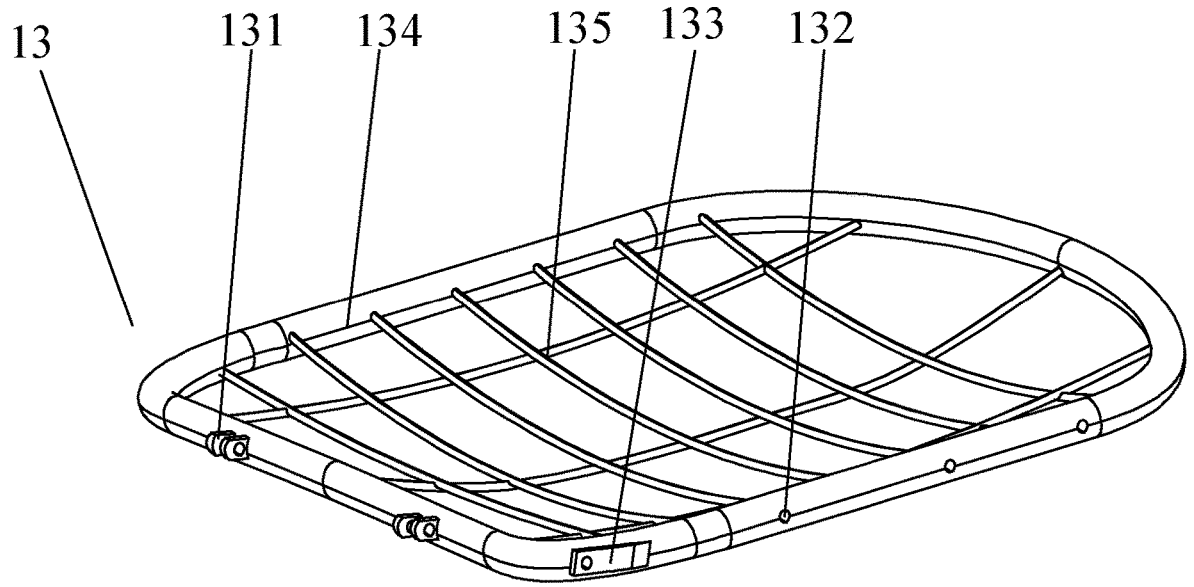
FIG. 3 is structure diagram of the hanging basket chair of the present invention.
Figure 4:
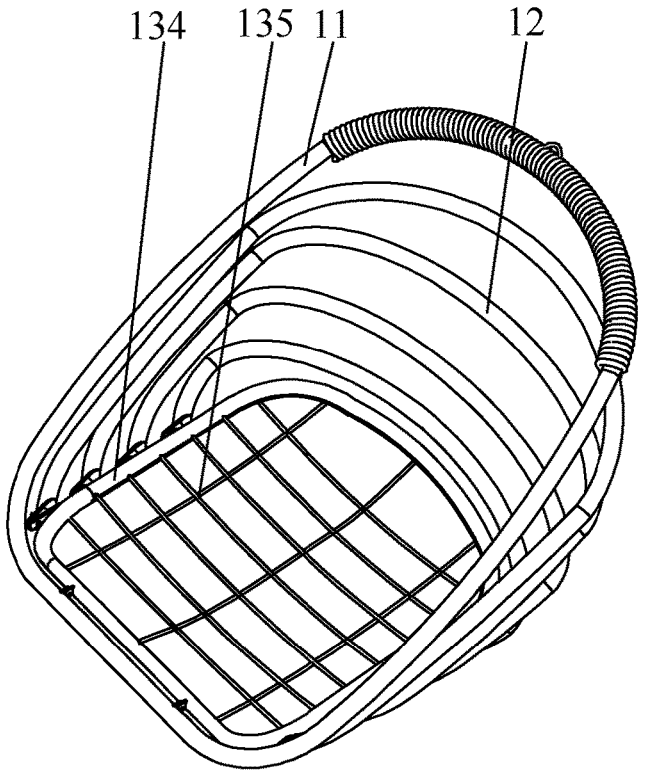
FIG. 4 is structure diagram of the hanging basket body of the present invention.
Figure 4A:
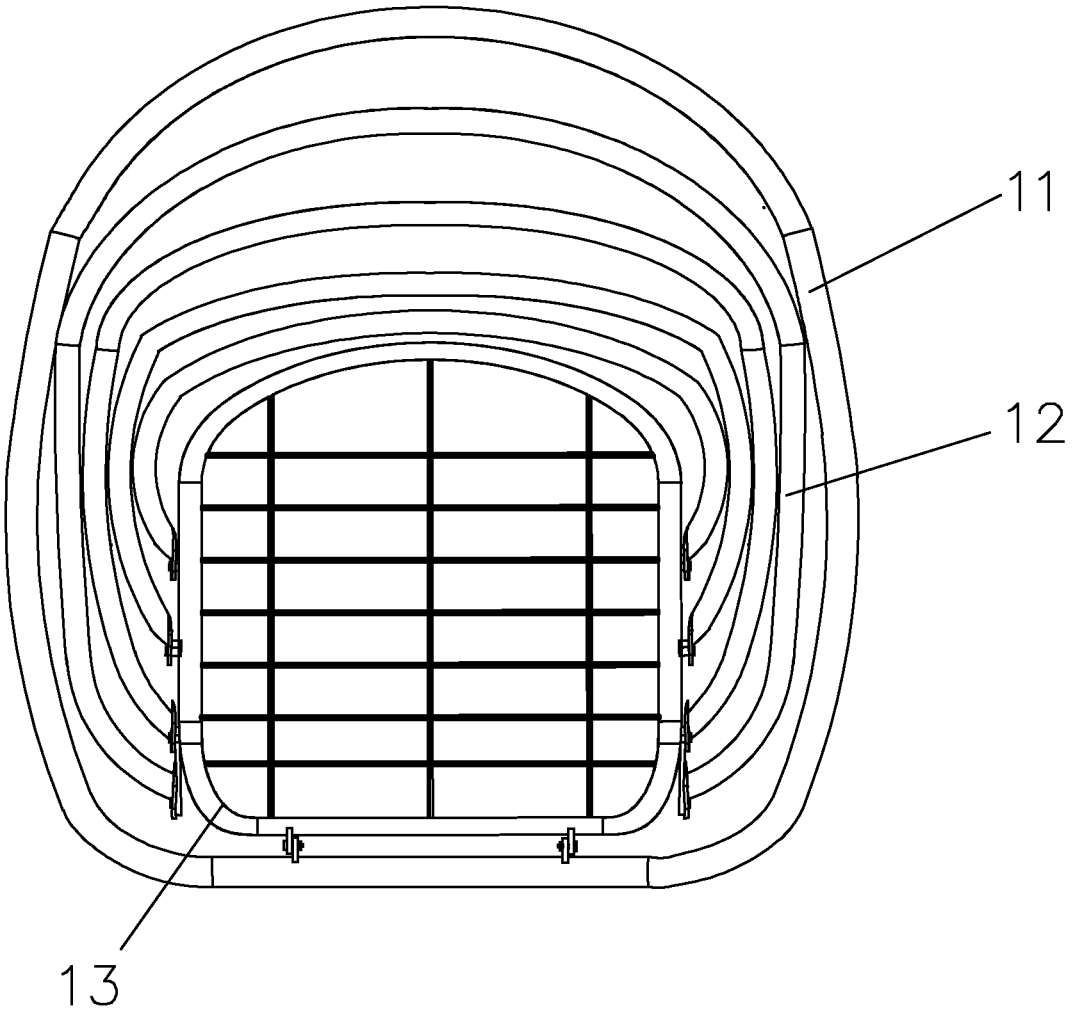
FIG. 4A is structure diagram showing that main frame and auxiliary frames of hanging basket body are folded in a plane of the hanging basket chair.
Figure 4B:
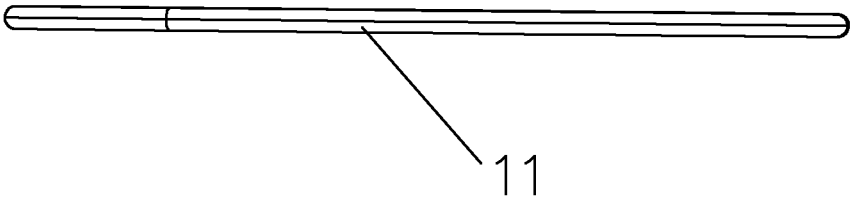
FIG. 4B is a schematic side view of FIG. 4A.
Figure 5:
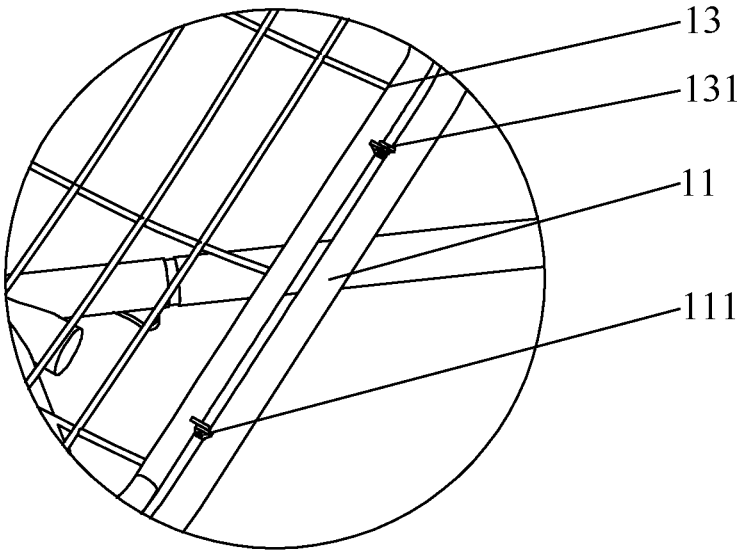
FIG. 5 is structure diagram of the hinge joint between the main frame and the hanging basket chair of the present invention.
Figure 6:
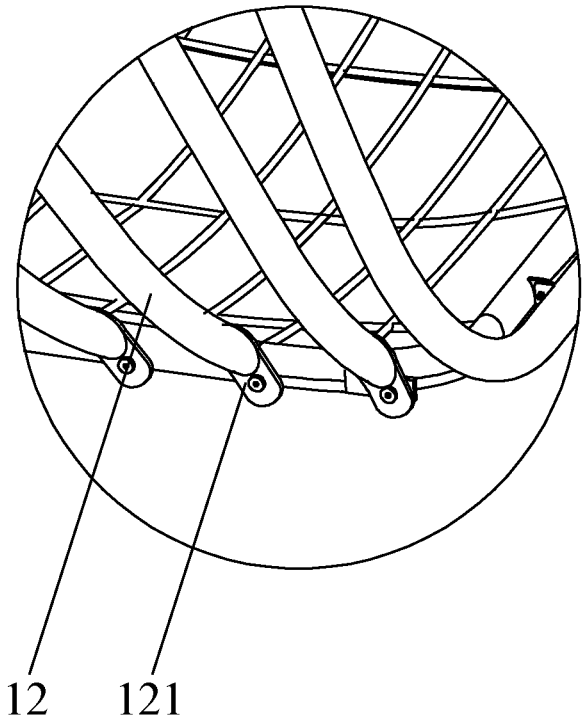
FIG. 6 is structure diagram of the hinge joint between the auxiliary frame and the hanging basket chair of the present invention.
Figure 7:
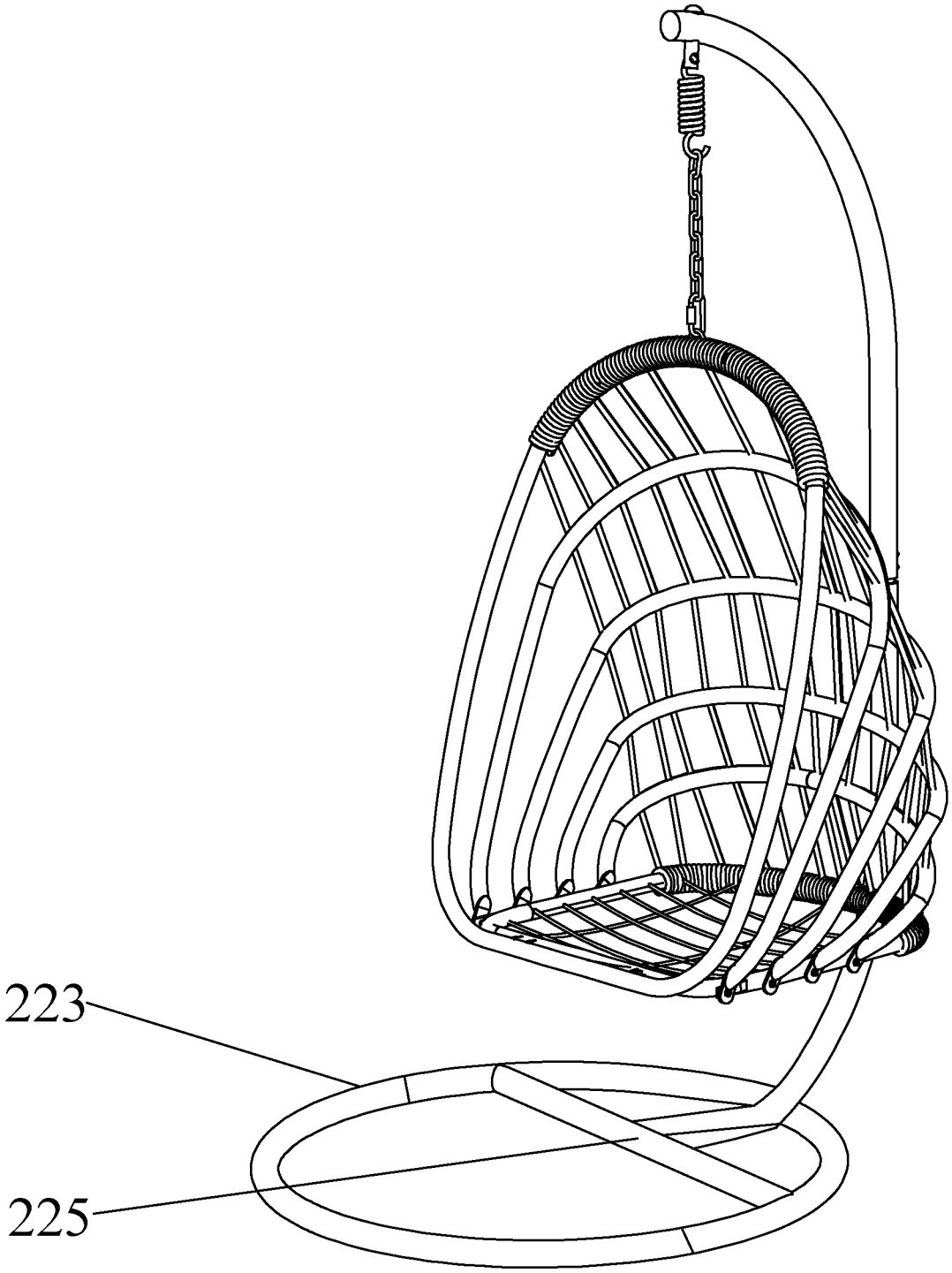
FIG. 7 is structure diagram 3 of the whole structure of the present invention.
Figure 8:
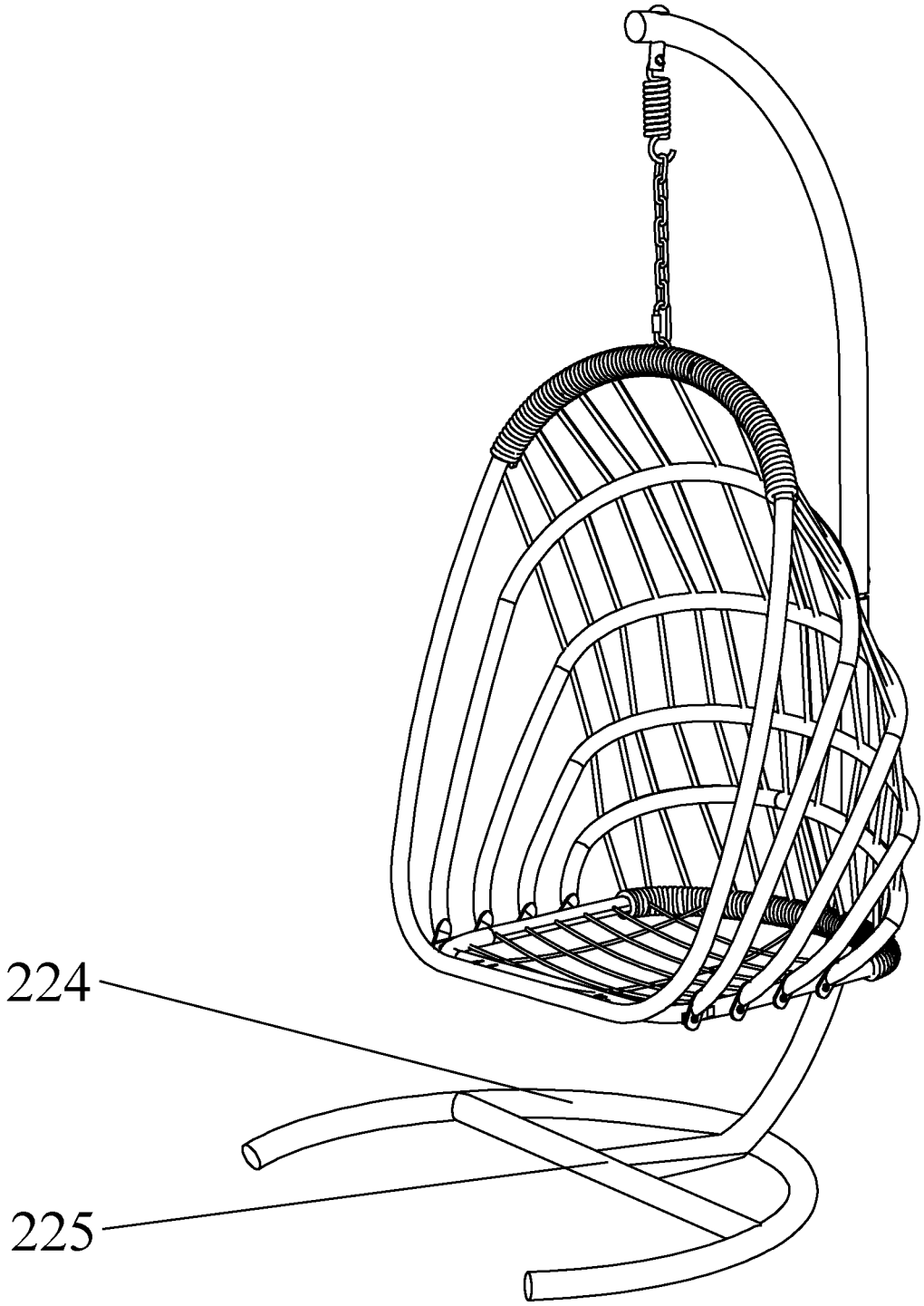
FIG. 8 is structure diagram 4 of the whole structure of the present invention.
Figure 9:
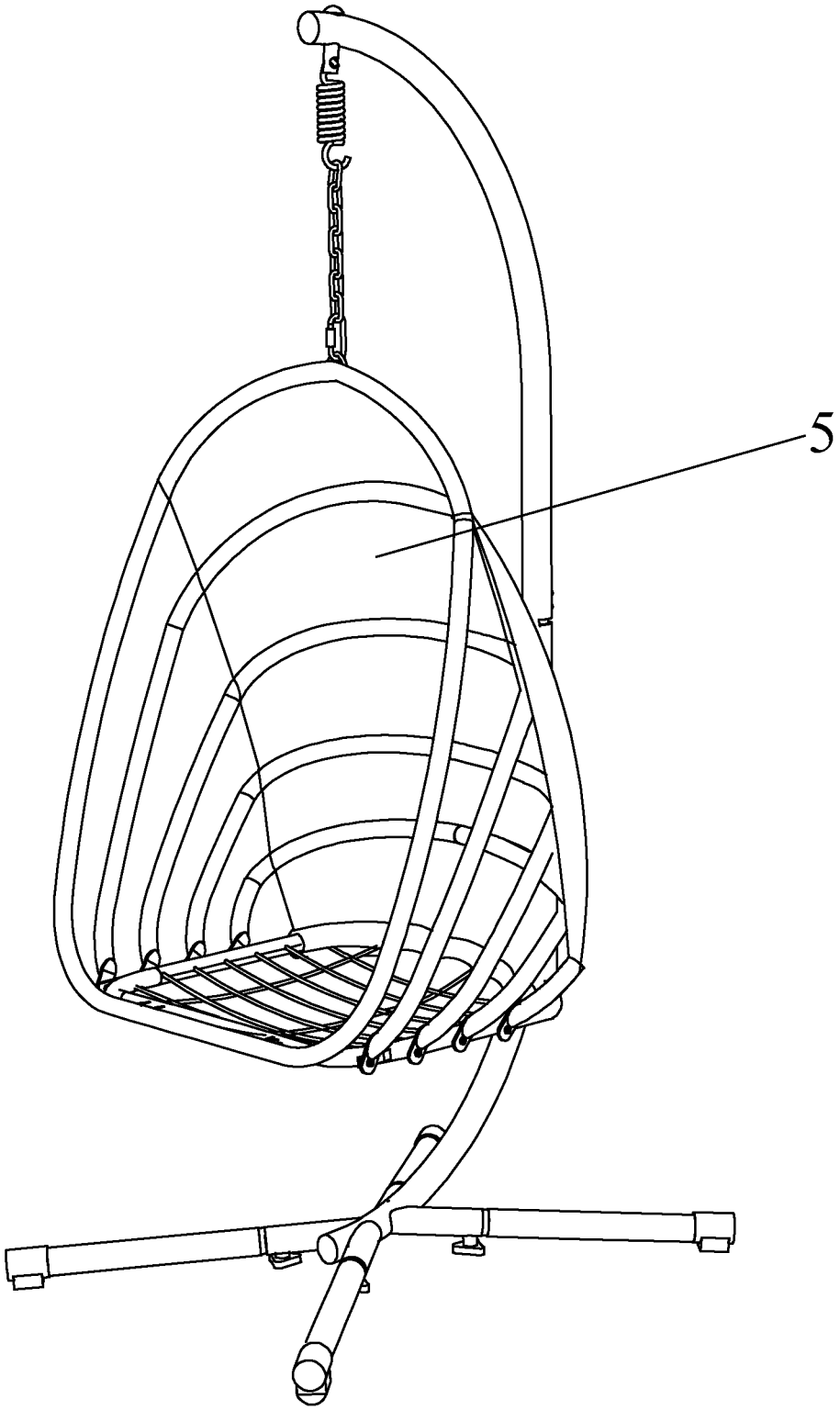
FIG. 9 is structure diagram 5 of the whole structure of the present invention.

As shown in FIGS. 1-9, a foldable hanging basket comprises a hanger 2 and a hanging basket body 1. The hanging basket body 1 is suspended on the hanger 2 by a sling chain 4. The sling chain 4 comprises a sling chain body 42 and a spring hook 41, one end of the sling chain body 42 is matched with one end of the spring hook 41, the other end of the sling chain body 42 is matched with a hoist ring at an upper end of the main frame 11, the other end of the spring hook 41 is matched with the hanger 2, so as to install the suspension of the hanging basket body 1.

Specifically, the hanging basket body 1 comprises a hanging basket chair 13 and a lifting frame assembly. The lifting frame assembly comprises a main frame 11 and several auxiliary frames 12. The main frame 11 and the several auxiliary frames 12 are arranged in intervals, a lower border of the main frame 11 is hinged and matched with a front border of the hanging basket chair 13, and two ends of each of the several auxiliary frames 12 are successively hinged and matched with borders on both sides of the hanging basket chair 13. The main frame 11 and several auxiliary frames 12 may be rotated and folded in a plane of the hanging basket chair 13. The design of the hinge joint between the lifting frame assembly and the hanging basket chair 13 is optimized, so that each hinge position point is in the same plane, thus the whole body can be better folded in one plane, so as to further reduce the package volume during transportation.

Specifically, each of the auxiliary frames 12 is of an inversed U shape, and several auxiliary frames 12 are arranged backward from larger size to smaller size. When the main frame 11 and several auxiliary frames 12 are rotated and folded in the same plane with the hanging basket chair 13, the several auxiliary frames 12 and the hanging basket chair 13 are in the intracavity of the main frame 11. When the main frame 11 and several auxiliary frames 12 are in a state of suspension and unfolding, an included angle between the main frame 11 and the hanging basket chair 13 is greater than an included angle between the auxiliary frame 12 and the hanging basket chair 13.

The above structure design is optimized, so that the main frame 11 and the main and several auxiliary frames 12 do not obstruct each other after folding, resulting in a more flat product.

Specifically, two lifting lugs 131 are arranged outside the front border of the hanging basket chair 13, the lifting lug 131 can be designed as a single lifting lug or double lifting lugs, and two hinge seats 111 are arranged inside the lower border of the main frame 11. The lifting lugs 131 and the hinge seats 111 are correspondingly matched, and are hinged with hinge shafts. In another embodiment, the lifting lugs and the hinge seats may have structural positions exchanged and installed.

Specifically, several hinge holes 132 are arranged on the borders on the borders on two sides of the hanging basket chair 13. To make each part better folded without obstruction, a hinge position at both ends of the auxiliary frame 12 closest to the main frame 11 is normally hinged through the auxiliary support 133, the auxiliary support 133 is installed at extending part of side borders of the hanging basket chair 13, both ends of the auxiliary frame 12 are provided with hinge supports 121, the hinge supports 121 and the hinge holes 132 are hinged with shafts.

Specifically, the hanging basket chair 13 comprises a hanging basket chair frame 134 and a mesh pad 135 located within the hanging basket chair frame 134, and the mesh pad 135 is composed of several crisscrossed rods. The mesh pad 135 is preferably composed of iron mesh or fiber rope mesh.

In one preferable embodiment, several braided ropes 3 are connected between the main frame 11, the auxiliary frame 12 and the hanging basket chair 13, the braided ropes 3 form a hanging basket net, the braided ropes 3 are made of flexible materials, so that the main frame 11, the auxiliary frame 12 and the hanging basket chair 13 can be folded between each other.

In one preferable embodiment, the main frame 11, the auxiliary frame 12 and the hanging basket chair 13 are connected via hanging basket cloth 5, the hanging basket cloth 5 is used to completely or partially cover the main frame 11 and the auxiliary frame 12, so that the main frame 11, the auxiliary frame 12 and the hanging basket chair 13 can be folded between each other.

Specifically, the hanger 2 comprises suspenders 21 and a base 22, and each of the suspenders 21 is of a detachable suspender structure.

In one preferable embodiment, each of the suspenders 21 comprises an upper suspender 211 and a lower suspender 212, the upper suspender 211 comprises an upper arc-shaped rod part and an upper straight rod part disposed integrally, and the lower suspender 212 comprises a lower straight rod part and a lower arc-shaped rod part disposed integrally, and a lower end of the upper straight rod part is socketed with an upper end of the lower straight rod part. The suspender structure is of a detachable structure, so as to reduce the package volume.

In one preferable embodiment, the base 22 is a detachable base, and the base 22 comprises a center seat and several supporting legs 221. The center seat comprises several central inserting bars 222 welded on the lower arc-shaped rod part, and a single supporting leg 221 is used to be socketed with a single central inserting bar 222.

In one preferable embodiment, the base 22 is a ring base 223, a reinforcing beam 225 is arranged in the ring base 223, and the ring base 223 is formed by socketing detachable ring pipes.

In one preferable embodiment, the base 22 comprises a C-shaped frame 224, the C-shaped bottom frame 224 is provided with a reinforcing beam 225, and the C-shaped bottom frame 224 is formed by socketing detachable circular pipes.

The abovementioned base structure is optimized, and a detachable structure design is used to reduce the package volume.

The present invention optimizes the structure of the lifting frame assembly, and hinges and matches it with the hanging basket chair, so that each hinge position point is in a same plane, so as to achieve a better overall folding of the lifting frame assembly in a plane, thus further reducing the package volume during transportation. The present invention also optimizes the structure of suspender and base, so as to reduce the package volume during transportation with a removable and fast-assembling structure design.

It can be known from the technical common sense that the present invention can be achieved with other implementation schemes without departing from spiritual essence or essential features of the present invention. Therefore, the above disclosed implementation scheme is only an example in all aspects, and it is not the only one. All changes within the scope of the present invention or its equivalent are included in the present invention.

What is claimed is:

1. A foldable hanging basket, comprising a hanger and a hanging basket body, wherein the hanging basket body is suspended on the hanger by a sling chain, the hanging basket body comprises a hanging basket chair and a lifting frame assembly; the lifting frame assembly comprises a main frame and a plurality of auxiliary frames; the main frame and the auxiliary frames are arranged in intervals, a lower border of the main frame is hinged and matched with a front border of the hanging basket chair, and two ends of each of the auxiliary frames are successively hinged and matched with borders on both sides of the hanging basket chair; the main frame and the auxiliary frames are rotatable and foldable in a plane of the hanging basket chair.

2. The foldable hanging basket according to claim 1, wherein each of the auxiliary frames is of an inversed U shape, the auxiliary frames are arranged backward from larger size to smaller size; when the main frame and the auxiliary frames are rotated and folded in the same plane with the hanging basket chair, the auxiliary frames and the hanging basket chair are in an intracavity of the main frame.

3. The foldable hanging basket according to claim 2, wherein when the main frame and the several auxiliary frames are in a state of suspension and unfolding, an included angle between the main frame and the hanging basket chair is greater than an included angle between the auxiliary frames and the hanging basket chair.

4. The foldable hanging basket according to claim 2, wherein two lifting lugs are arranged outside the front border of the hanging basket chair, and two hinge seats are arranged inside the lower border of the main frame; the lifting lugs and the hinge seats are correspondingly matched, and are hinged with hinge shafts.

5. The foldable hanging basket according to claim 4, wherein a plurality of hinge holes are arranged on the borders on the two sides of the hanging basket chair, and hinge supports are arranged on the two ends of each of the auxiliary frame; the hinge supports and the hinge holes are hinged with hinge shafts.

6. The foldable hanging basket according to claim 5, wherein the hanging basket chair comprises a hanging basket chair frame and a mesh pad located within the hanging basket chair frame, and the mesh pad is composed of a plurality of crisscrossed rods.

7. The foldable hanging basket according to claim 5, wherein an auxiliary support extending outwards is arranged in front of the borders on the both sides of the hanging basket chair, the auxiliary support is provided with a hinge hole, and the auxiliary support is configured to match with the auxiliary frame closest to the main frame.

8. The foldable hanging basket according to claim 1, wherein a plurality of braided ropes are connected between the main frame, the auxiliary frames and the hanging basket chair, the braided ropes form a hanging basket net, and the braided ropes are made of flexible material.

9. The foldable hanging basket according to claim 1, wherein the main frame, the auxiliary frames and the hanging basket chair are connected via hanging basket cloth, and the hanging basket cloth is configured to completely or partially cover the main frame and the auxiliary frames.

10. The foldable hanging basket according to claim 1, wherein the sling chain comprises a sling chain body and a spring hook, one end of the sling chain body is matched with one end of the spring hook, the other end of the sling chain body is matched with a hoist ring at an upper end of the main frame, the other end of the spring hook is matched with the hanger.

11. The foldable hanging basket according to claim 10, wherein the hanger comprises suspenders and a base, and each of the suspenders is of a detachable suspender structure.

12. The foldable hanging basket according to claim 11, wherein each of the suspenders comprises an upper suspender and a lower suspender, the upper suspender comprises an upper arc-shaped rod part and an upper straight rod part disposed integrally, and the lower suspender comprises a lower straight rod part and a lower arc-shaped rod part disposed integrally.

13. The foldable hanging basket according to claim 12, wherein a lower end of the upper straight rod part is socketed with an upper end of the lower straight rod part.

14. The foldable hanging basket according to claim 12, wherein the base is a detachable base, the base comprises a center seat and a plurality of supporting legs; the center seat comprises a plurality of central inserting bars welded on the lower arc-shaped rod part, and a single supporting leg is configured to be socketed with a single central inserting bar.

15. The foldable hanging basket according to claim 11, wherein the base is a ring base, a reinforcing beam is arranged in the ring base, the ring base is formed by socketing detachable ring pipes.

16. The foldable hanging basket according to claim 11, wherein the base comprises a C-shaped bottom frame, the C-shaped bottom frame is provided with a reinforcing beam, and the C-shaped bottom frame is formed by socketing detachable circular pipes.

* * * * *